US009516913B2

(12) United States Patent
Mazzarolo

(10) Patent No.: US 9,516,913 B2
(45) Date of Patent: Dec. 13, 2016

(54) MOTORCYCLING BOOT WITH IMPROVED COMFORT

(75) Inventor: Giovanni Mazzarolo, Coste di Maser (IT)

(73) Assignee: ALPINESTARS RESEARCH SRL, Coste di Maser (Treviso) (IT)

( * ) Notice: Subject to any disclaimer, the term of this patent is extended or adjusted under 35 U.S.C. 154(b) by 361 days.

(21) Appl. No.: 13/501,372

(22) PCT Filed: Oct. 11, 2010

(86) PCT No.: PCT/IB2010/054582

§ 371 (c)(1),
(2), (4) Date: Apr. 11, 2012

(87) PCT Pub. No.: WO2011/045724

PCT Pub. Date: Apr. 21, 2011

(65) Prior Publication Data

US 2012/0198724 A1 Aug. 9, 2012

(30) Foreign Application Priority Data

Oct. 12, 2009 (IT) ..... MI2009A0200

(51) Int. Cl.
*A43B 5/14* (2006.01)
*A43B 5/04* (2006.01)

(52) U.S. Cl.
CPC ..... *A43B 5/145* (2013.01); *A43B 5/0456* (2013.01); *A43B 5/0458* (2013.01)

(58) Field of Classification Search
CPC ..... A43B 3/0073; A43B 5/145; A43B 5/0486; A43B 5/1666; A43B 23/02; A43B 23/0275; A43B 5/0431; A43B 5/0452; A43B 5/0456; A43B 5/0458; A43B 5/0468; A43B 23/027
(Continued)

(56) References Cited

U.S. PATENT DOCUMENTS 143,537 A * 10/1873 Silbeeschmidt ..... 602/27
1,489,470 A * 4/1924 Thomas ..... 24/713.7
(Continued)

FOREIGN PATENT DOCUMENTS

EP 1397971 A1 3/2004
EP 1621090 A1 2/2006
(Continued)

OTHER PUBLICATIONS

"PCT International Search Report dated Feb. 18, 2011 for PCT/IB2010/054582, from which the instant application is based," 3 pgs.
(Continued)

*Primary Examiner* — Khoa Huynh
*Assistant Examiner* — Megan Brandon
(74) *Attorney, Agent, or Firm* — Fredrikson & Byron, P.A.

(57) ABSTRACT

A motorcycling boot, in particular a motocross boot comprises a sole and an upper in turn comprising a bottom portion, suitable for surrounding the user's foot, and a leg-piece suitable for surrounding the user's leg. A first protection means is connected to said leg-piece in the region of the shin, while a second protection means is connected to said leg-piece in the region of the calf. Said first protection means comprises an element suitable for sliding inside guiding means formed in said first protection means, while said second protection means comprises an element suitable for sliding inside guiding means formed in said second protection means. The movement of said elements allows variation, during use of the boot, of the configuration of the leg-piece.

28 Claims, 10 Drawing Sheets

(58) Field of Classification Search
USPC ..... 36/109, 96, 71, 76 R, 72 R, 71.5, 36/109, 72 A,36/131, 89, 118.2, 118.5, 36/131, 119.1
See application file for complete search history.

(56) References Cited

U.S. PATENT DOCUMENTS

| | | | | |
|---|---|---|---|---|
| 3,854,228 | A * | 12/1974 | Conroy | 36/71 |
| 4,095,356 | A * | 6/1978 | Robran | A43B 5/0458 36/105 |
| 4,882,858 | A * | 11/1989 | Signori | 36/131 |
| 5,575,091 | A * | 11/1996 | Mattiuzzo | 36/118.2 |
| 5,722,187 | A * | 3/1998 | Pamio et al. | 36/88 |
| 5,941,554 | A * | 8/1999 | Bourdeau | 280/617 |
| 6,076,287 | A * | 6/2000 | Savard | 36/118.2 |
| 6,283,494 | B1 * | 9/2001 | Bourdeau | 280/617 |
| 6,826,853 | B1 * | 12/2004 | Zanatta | 36/131 |
| 6,935,054 | B2 * | 8/2005 | Hall et al. | 36/117.1 |
| 8,307,572 | B2 * | 11/2012 | Foxen et al. | 36/131 |
| 2002/0053147 | A1 * | 5/2002 | Borsoi et al. | 36/54 |
| 2003/0115775 | A1 * | 6/2003 | Mazzarolo | 36/89 |
| 2004/0250452 | A1 * | 12/2004 | Farys | 36/89 |
| 2005/0223599 | A1 * | 10/2005 | Valat et al. | 36/72 R |
| 2005/0257404 | A1 * | 11/2005 | Daza | 36/72 R |
| 2006/0179686 | A1 * | 8/2006 | Labonte | 36/89 |
| 2006/0185192 | A1 * | 8/2006 | Biancucci | 36/45 |
| 2007/0101615 | A1 * | 5/2007 | Munns | 36/50.1 |
| 2007/0175069 | A1 * | 8/2007 | Zanatta | 36/131 |
| 2008/0201987 | A1 * | 8/2008 | Bell | 36/84 |
| 2009/0188133 | A1 * | 7/2009 | Munns | 36/131 |
| 2009/0277045 | A1 * | 11/2009 | Sartor et al. | 36/117.2 |
| 2011/0067271 | A1 * | 3/2011 | Foxen et al. | 36/131 |
| 2011/0173841 | A1 * | 7/2011 | McDuff | 36/89 |
| 2013/0019508 | A1 * | 1/2013 | Smith et al. | 36/72 R |

FOREIGN PATENT DOCUMENTS

| | | | |
|---|---|---|---|
| EP | 1815762 | A1 | 8/2007 |
| FR | 2337515 | A1 | 8/1977 |

OTHER PUBLICATIONS

"PCT Written Opinion dated Feb. 18, 2011 for PCT/IB2010/054582, from which the instant application is based," 4 pgs.
"European Search Report and Written Opinion, including English translation, dated Jun. 11, 2010 for IT TV20090200, from which the instant application is based," 10 pgs.

* cited by examiner

MOTORCYCLING BOOT WITH IMPROVED COMFORT

RELATED APPLICATIONS

This application is a 35 U.S.C. 371 national stage filing from International Application No. PCT/IB2010/054582 filed Oct. 11, 2010, which claims priority to Italian Application No. TV2009A000200 filed Oct. 12, 2009, the teachings of which are incorporated herein by reference.

BACKGROUND

The present invention relates to a motorcycling boot, in particular a motocross boot.

It is known that the lower limbs of motorcyclists are prone to injury, which may also be of a serious nature, in the event of accidental falls or impacts.

In order to reduce this risk as far as possible, during recent years special boots which have increased considerably the level of safety for users have been developed.

The safety offered by conventional leather boots has been greatly increased by introducing suitable protection means made of rigid or semi-rigid plastic.

Said protection means, which are mounted in the zones of the leg most exposed to injury, such as the instep, toes, shin, calf, may be directly injected onto the upper which forms part of the boot or may be applied by means of suitable gluing.

With use of these protection means not only is the motorcyclist's leg adequately protected against possible impacts or friction on the ground, but also unnatural movements of the lower limb as a result of the forces produced by an impact or accident are prevented.

In these boots which incorporate rigid and/or semi-rigid protection means it is known to provide soft portions in the region of the ankle joint so as to allow flexing of the foot.

In this way the foot is allowed a certain freedom of movement, while keeping it protected and supported, together with the ankle.

The abovementioned boots, although widely appreciated, are not without drawbacks.

In particular, the protection means arranged at the shin and calf, while they provide adequate protection, on the other hand make the boot rigid, limiting its comfort.

In fact, it has been possible to establish that, despite the soft portion provided in the ankle region, the rigid protection means on the shin and on the calf, since they are able to flex only by a small amount, also limit the backwards and forwards flexing movement of the boot leg-piece.

The top portion of the boot, in fact, may be regarded on the whole as being a single rigid body.

During these backwards or forwards flexing movements the leg-piece of the boot no longer fits the shape of the leg and it is possible that, in particular at the bottom ends, said protection means may exert a considerable pressure on the user's leg, causing discomfort, which is only partly relieved by the presence of suitable padding.

By way of a further consequence, whenever the leg-piece of the boot flexes forwards or backwards numerous folds form on the boot upper, at the instep or heel, and these may also be the cause of discomfort for the user.

Finally, said protection means do not allow the boot leg-piece to fit perfectly to calves and legs of different sizes.

Said drawback is partly offset by the provision of suitable closing devices which allow the upper and the associated protection means to adhere to the leg in a satisfactory manner.

It is evident, however, that in particular in the case of calves which are bigger than normal, the inability of the boot to fit to the rear profile of the leg creates a certain amount of discomfort.

BRIEF SUMMARY OF EMBODIMENTS OF THE INVENTION

The object of the present invention is therefore to overcome the drawbacks of the prior art.

In particular, a task of the present invention is to provide a motocross boot which provides adequate protection for the user's leg and foot, but at the same time allows greater flexing of the top portion of the leg-piece.

Moreover, a task of the present invention is to provide a motocross boot with an improved capacity to fit to legs and calves of different sizes.

The object and the abovementioned tasks are achieved by a motorcycling boot according to claim 1.

BRIEF DESCRIPTIONS OF THE DRAWINGS

The characteristic features and further advantages of the invention will emerge from the description provided hereinbelow, of an example of embodiment, provided by way of a non-limiting example, with reference to the accompanying drawings in which.

Figures 6, 6A, 6B:
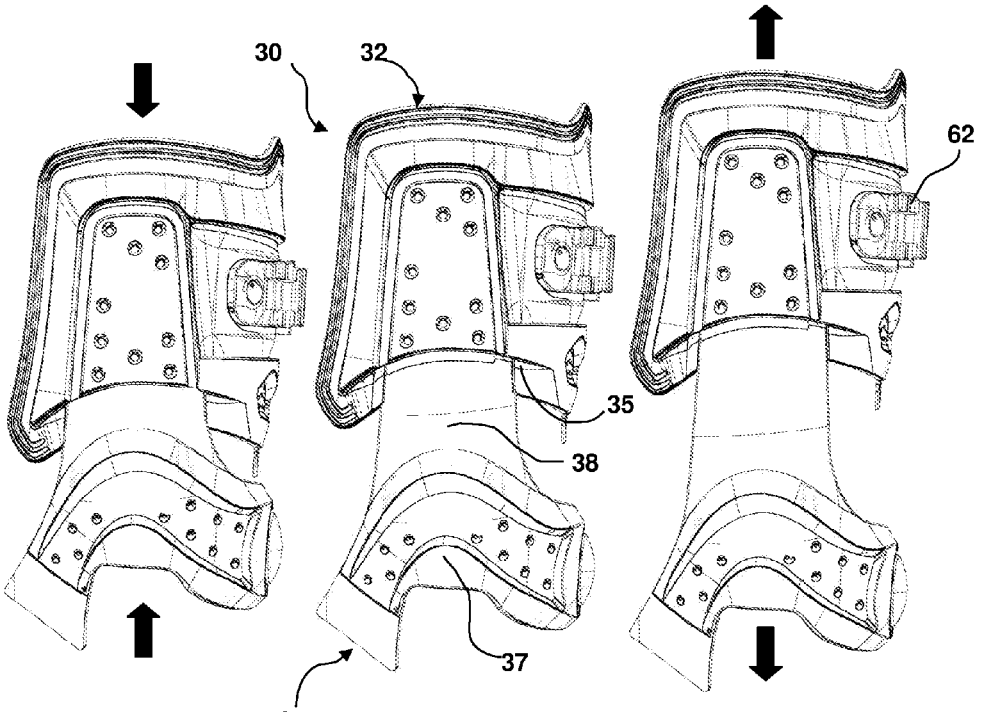
Figures 7, 7A, 7B:
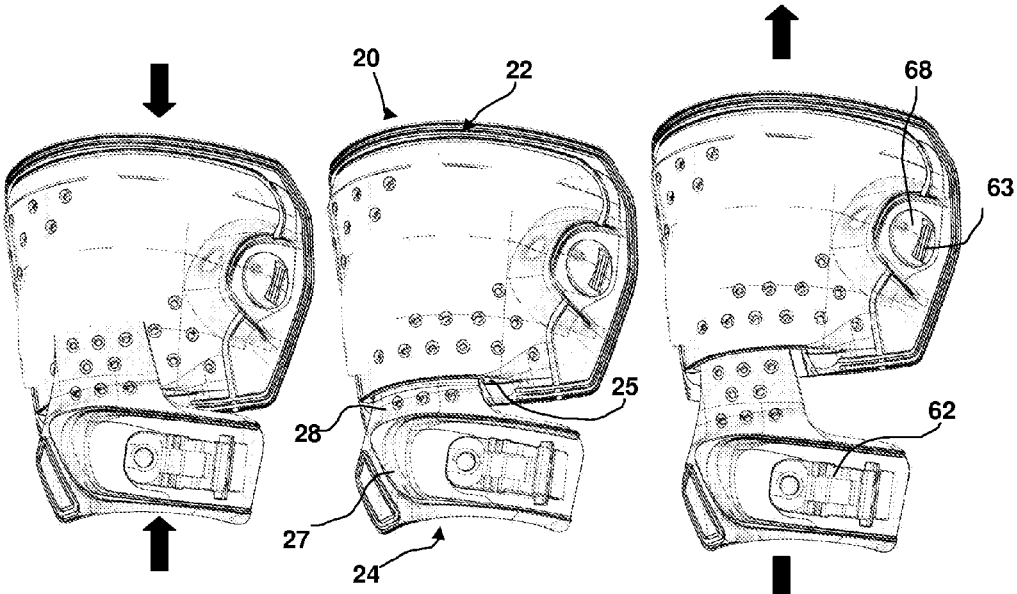
Figures 8, 8A, 8B, 8C, 8D, 8E, 8F:
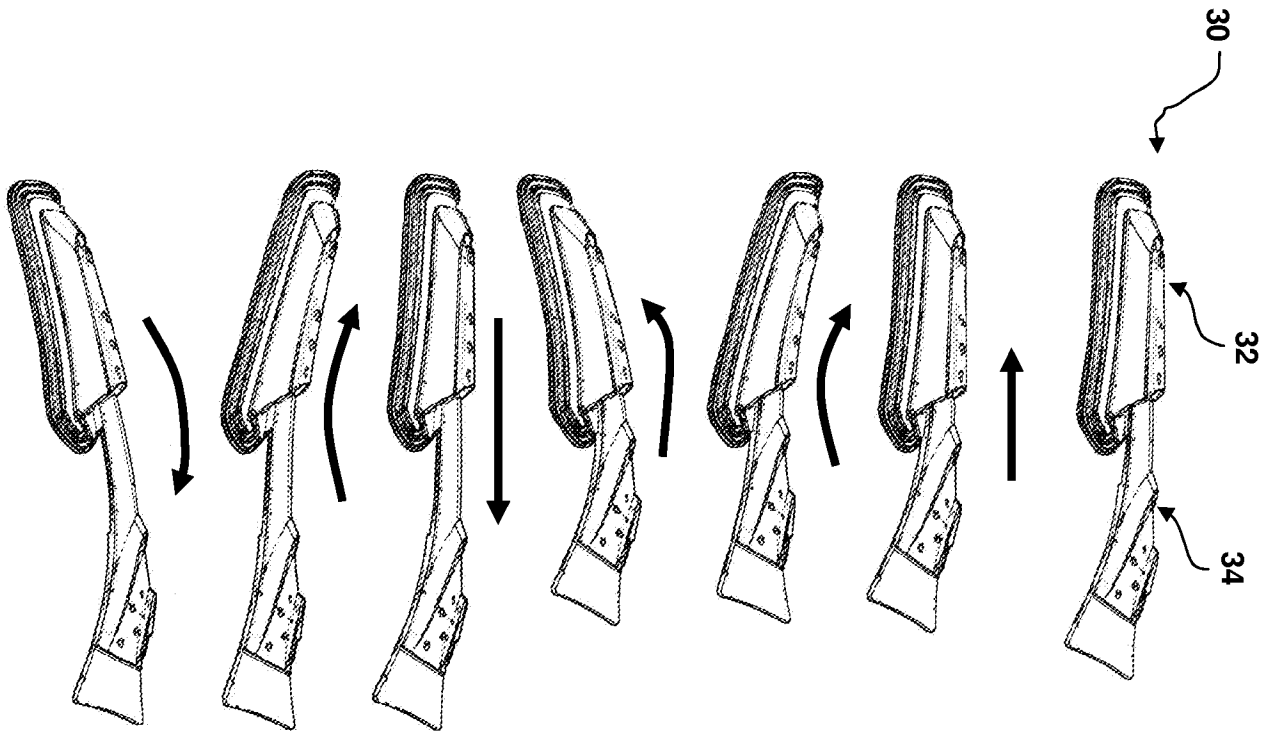
Figure 9:
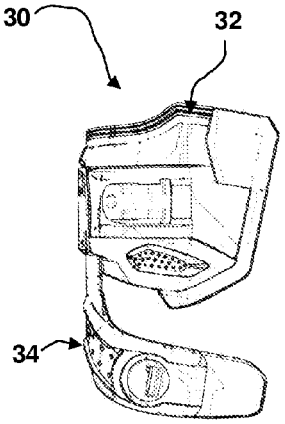
Figure 9A:
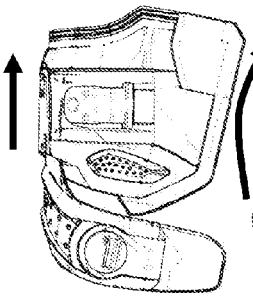
Figure 9B:
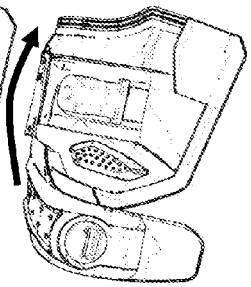
Figure 9C:
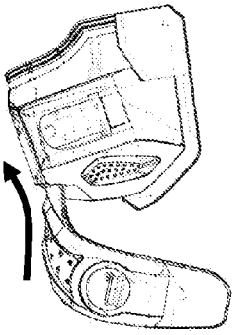
Figure 9D:
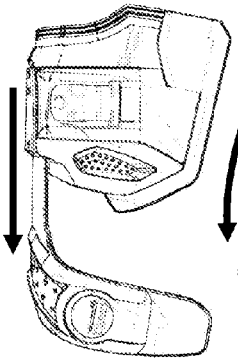
Figure 9E:
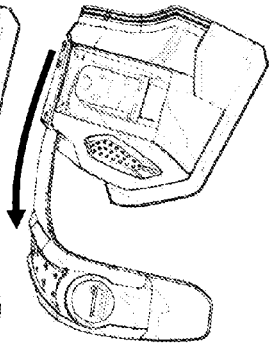
Figure 9F:
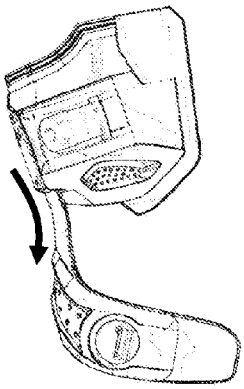
Figure 10:
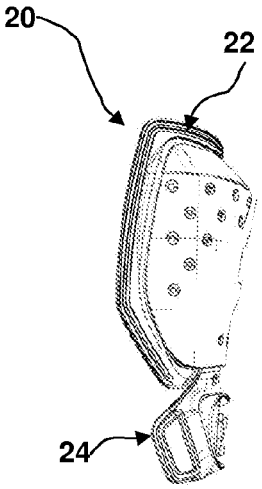
Figure 10A:
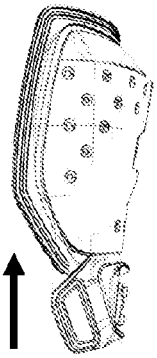
Figure 10B:
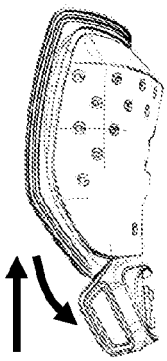
Figure 10C:
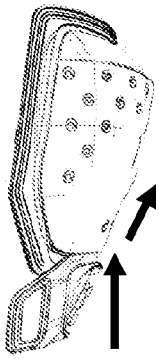
Figure 10D:
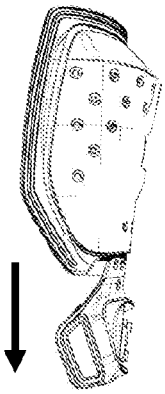
Figure 10E:
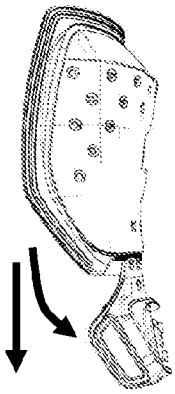
Figure 10F:
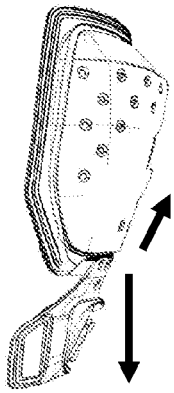
Figure 11A:
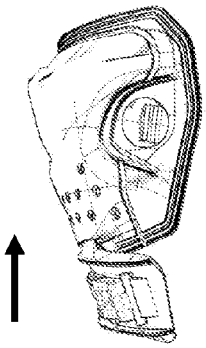
Figure 11B:
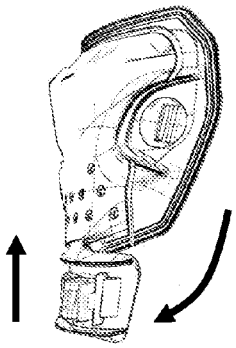
Figure 11C:
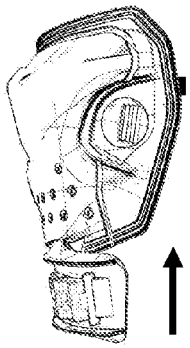
Figure 11:
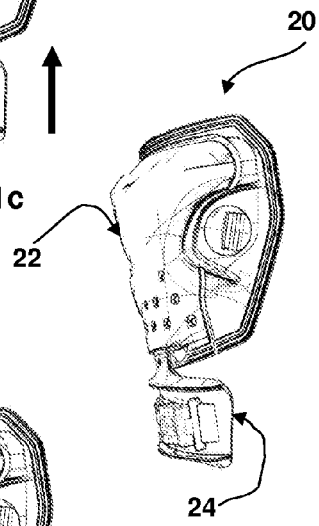
Figure 11D:
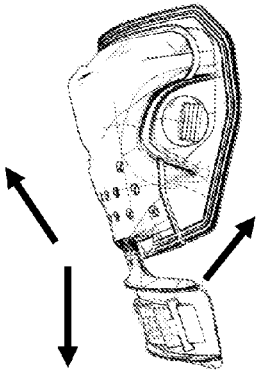
Figure 11E:
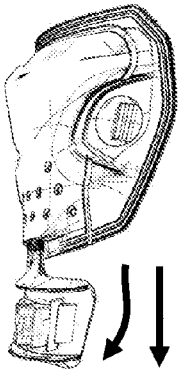
Figure 11F:
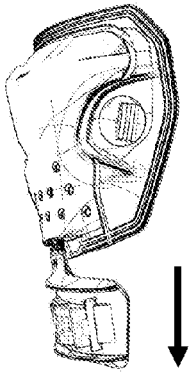

FIGS. 6, 6*a* and 6*b* show a rear view of the rear protection means of the boot according to the invention in three different operating conditions;

FIGS. 7, 7*a* and 7*b* show a front view of the front protection means of the boot according to the invention in three different operating conditions;

FIGS. 8, 8*a*, 8*b*, 8*c*, 8*d*, 8*e*, 8*f* show a first side view of the rear protection means of the boot according to the invention in different operating conditions;

FIGS. 9, 9*a*, 9*b*, 9*c*, 9*d*, 9*e*, 9*f* show a second side view of the rear protection means of the boot according to the invention in different operating conditions;

FIGS. 10, 10*a*, 10*b*, 10*c*, 10*d*, 10*e*, 10*f* show a first side view of the front protection means of the boot according to the invention in different operating conditions;

FIGS. 11, 11*a*, 11*b*, 11*c*, 11*d*, 11*e*, 11*f* show a second side view of the front protection means of the boot according to the invention in different operating conditions.

DETAILED DESCRIPTION OF EMBODIMENTS OF THE INVENTION

The present invention relates to a motorcycling boot 10, in particular a motocross boot.

The description of the boot 10 and its individual components which will be provided below relates to a boot 10 used correctly. In particular, "front" will be used to indicate the part of the boot, or of the individual components, which is relatively closer to the toes of the foot, while "rear" will be used to indicate the part of the boot, or of its individual components, which is relatively closer to the heel. Similarly, "top" will be used to refer to the part of the boot, or of the individual components, which is relatively further from the ground, while "bottom" will be used to indicate the part of the boot, or of the individual components, which is relatively closer to the ground.

With reference to FIGS. 1 to 5, the boot 10 comprises a sole 40 and an upper 14 in turn comprising a bottom portion 15, designed to surround the user's foot, and a leg-piece 16 designed to surround the user's leg.

A first protection means 20 is connected to said leg-piece 16 in the region of the shin, while a second protection means 30 is connected to said leg-piece 16 in the region of the calf.

Said first protection means 20 comprises an element 24 designed to slide inside guiding means 25 formed in said first protection 20, while said second protection means 30 comprises an element 34 designed to slide inside guiding means 35 formed in said second protection means. The movement of said elements 24, 34 allows variation, during use of the boot 10, of the configuration of the leg-piece 16.

The upper 14 is preferably made of leather or similar materials or synthetic fabrics and is formed by several parts which are generally joined together by means of stitching.

The upper 14 in some cases may be provided with soft plastic inserts 17 which are directly injected onto the upper 14 itself or are applied by means of stitching or thermo-forming.

The first protection means 20 and the second protection means 30 are generally made of rigid and/or semi-rigid plastic. They are applied to the top portion of the leg-piece 16 by means of suitable stitches or by means of known heat-welding methods.

It is known that the shin-bone has an oblong form, which is wider at the top where it enters into and forms part of the knee joint, narrower in the central portion and slightly wider in the bottom part where it is joined to the ankle.

In the preferred embodiment, the element 24 of the first protection means 20 is positioned on the front portion of the leg-piece 16 at the central portion of the shin.

In addition to the element 24, preferably, the first protection means 20 also comprises a front plate 22 which is also positioned on the front portion of the leg-piece and which is shaped so as to be able to surround the top portion of the shin-bone.

As can be noted from FIGS. 1 to 5, the front plate 22 also covers the outer side portion of the top end of the shin. In this way the user is ensured greater protection in the event of impact against unforeseen obstacles. It should be noted that, during use, the inner side portion of the top end of the shin is directed towards the motorcycle and that it is unlikely to be affected by impacts with external bodies.

The thickness of the front plate 22 is not uniform: it is greater in the central portion and tapers gradually at the top and side ends.

Figure 5:
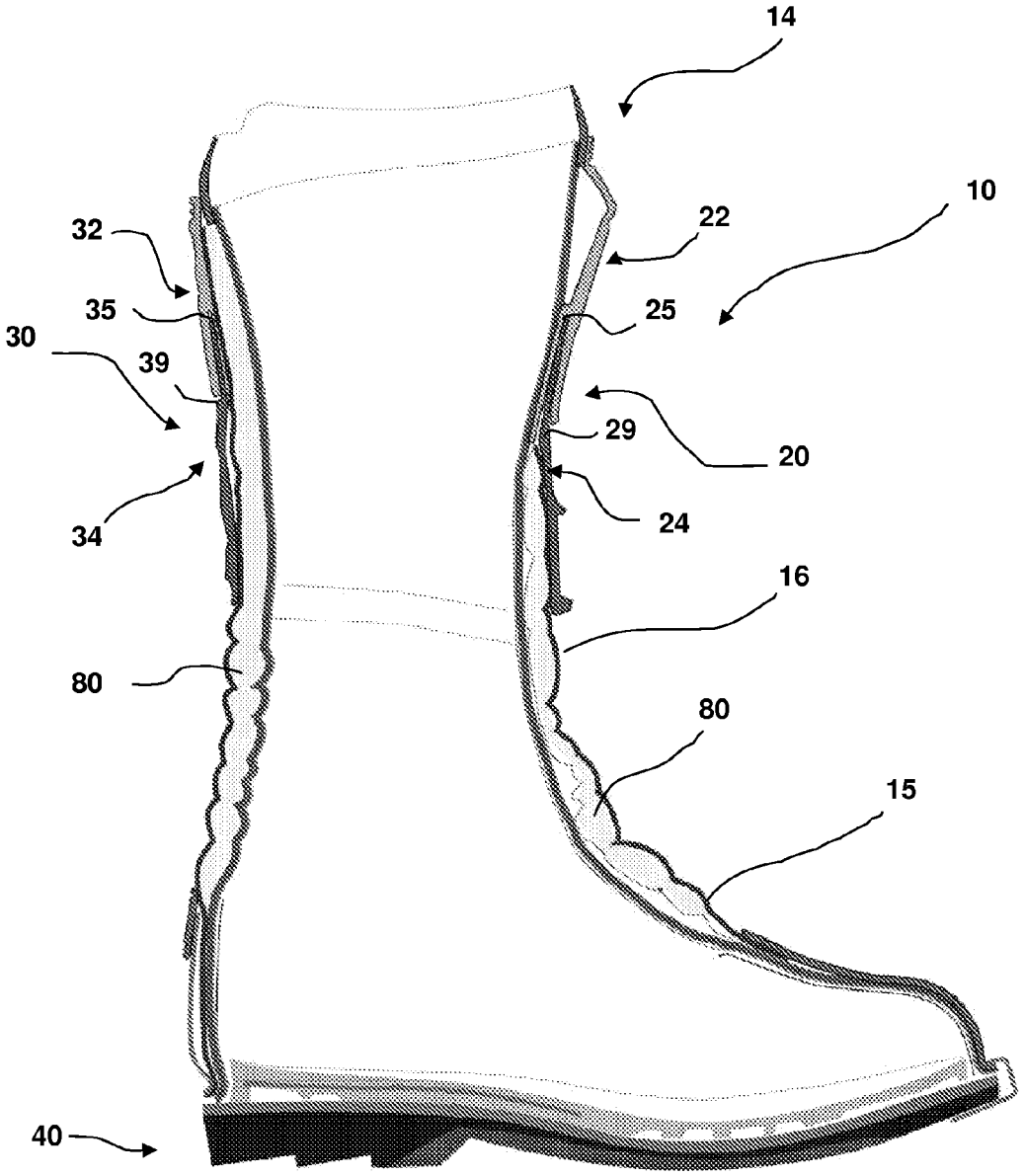
FIG. 5 shows schematically the cross-section along the plane indicated by the line V-V in FIG. 3.

Preferably, as shown in FIG. 5, the top portion of the front plate 22 is not arranged in contact with the underlying upper. In this way advantageously a kind of cavity is created so as to disperse effectively the impact energy which may develop following impact of the boot against an obstacle.

In the preferred embodiment, the guiding means 25 are provided in the central portion of the front plate 22 where, as mentioned above, the thickness of the protection means is greater.

Said guiding means 25 consist of a pocket with a substantially rectangular shape.

Figure 4:
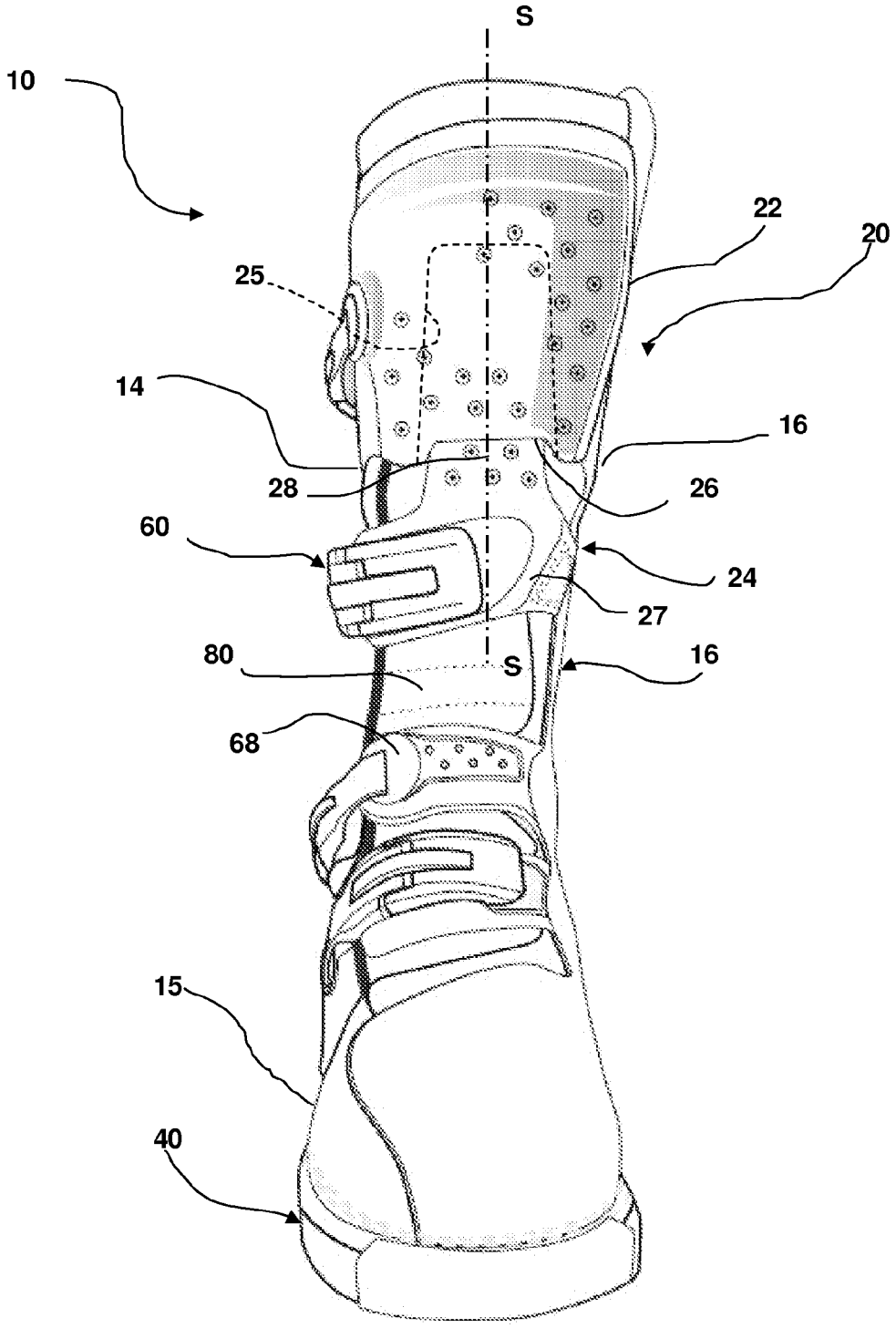
FIG. 4 shows a front view of the boot according to the invention.

As shown in FIG. 4, it is possible to define for said pocket 25 an axis of longitudinal symmetry S which substantially coincides with the hypothetical axis of symmetry of the leg, coinciding with the shin-bone.

Said pocket 25 communicates with the external environment by means of an opening 26 which is positioned at the bottom end of the front plate 22 and is suitable for housing internally the top end of the element 24 and guiding it, as will be described in detail below, during the respective movement.

In the preferred embodiment, the element 24 has substantially the shape of an overturned T and covers part of the central portion of the shin.

As shown in FIG. 4, the reference numbers 27 and 28 denote, respectively, the head-piece and the shank of said element 24.

The head-piece 27 of the element 24 is positioned on the upper 14 in a manner substantially parallel to the plane on which the boot 10 rests.

It is mounted on a portion of the upper 14 provided with suitable padding 80. In this way the user does not perceive any discomfort due to the presence of said rigid element in contact with the corresponding shin.

The shank 28 of the element 24, as shown in the accompanying figures, has a non-uniform thickness along its length.

In particular, as shown in FIG. 5, in the preferred embodiment, the thickness of said shank 28 gradually lessens towards the top end starting from a well-defined portion 29. Said portion 29 performs an end-of-travel function since the element 24 considered as a whole may slide in the direction of the front plate 22, inside the pocket 25, until the portion 29 comes into contact with the opening 26.

The shank 28, in fact, in the zone between the portion 29 and head-piece 27 of the element 24 has a thickness which is greater than the thickness of the pocket 25. As a result, sliding of the element 24 inside the pocket 25 beyond a well-defined point is prevented.

In the preferred embodiment, the width of the shank 28 is slightly smaller than the width of the pocket 25.

In this way the shank 28 is able also to perform a slight rotation inside the pocket 25. There exists therefore, albeit to a limited degree, a further possibility of relative movement of plate 22 and element 24.

In the preferred embodiment, the element 34 of the second protection means 30 is positioned at the central portion and bottom portion of the calf muscle.

In addition to the element 34, the protection means 30 comprise preferably also a rear plate 32 which is positioned on the rear portion of the leg-piece 16 and which is shaped so as to be able to surround the top portion of the user's calf muscle.

As can be noted from FIGS. 1 to 5, the rear plate 32 also covers the outer side portion of the top end of the calf.

When the boot 10 is closed by the user, the shin plate 22 is advantageously arranged over the end portion of said rear plate 32. In this way it is ensured that there are no zones of the top end of the leg which are left unprotected, apart from the zones facing the motorcycle.

The thickness of the rear plate 32 is not uniform: it is greater in the central portion and tapers gradually at the top and side ends.

The rear plate 32, as can be noted in FIG. 5, is preferably applied onto a portion of the leg-piece 16 provided with suitable padding 80. In this way the user does not perceive any discomfort due to the presence of said protection means 32 in contact with the calf muscle.

In the preferred embodiment, the guiding means 35 are provided in the central portion of the front plate 32 where, as mentioned above, the thickness of the protection means is greater.

Said guiding means 35 consist of a pocket with a substantially rectangular shape.

The axis of symmetry of said pocket 35 substantially coincides with the longitudinal axis of symmetry S of the pocket 25 provided in the front plate 22.

Said pocket 35 communicates with the external environment by means of an opening 36 which is positioned at the bottom end of the plate 32 and is suitable for housing internally the top end of the element 34 and guiding it, as will be described in detail below, during the respective movement.

The element 34 is also mounted on the upper 14 at a portion provided with suitable padding 80.

In the preferred embodiment, the element 34 has substantially the shape of an overturned Y.

Figure 3:
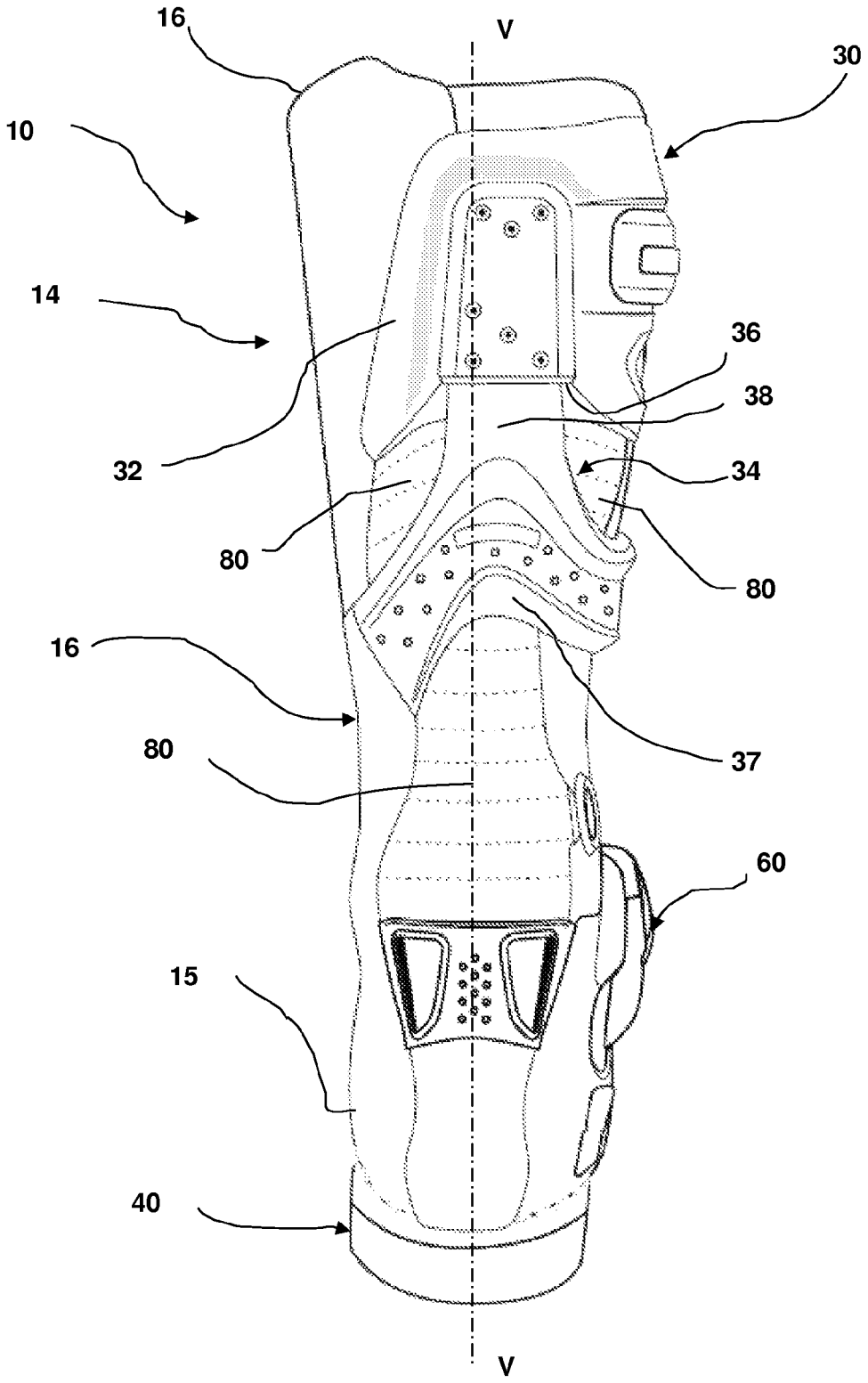
FIG. 3 shows a rear view of the boot according to the invention.

As shown in FIG. 3, the reference numbers 37 and 38 denote, respectively, the head-piece and the shank of said element 34.

In the preferred embodiment, the end of the head-piece 37 which is arranged along the outer side of the leg extends until it embraces almost completely the bottom portion of the calf.

In this way, when the boot 10 is closed by the user, the end 27 of the element 24 is advantageously arranged over said head-piece end.

The shank 38 of the element 34, as shown in the accompanying figures, has a non-uniform thickness along its length.

In particular, as shown in FIG. 5 and in a similar manner to that described above in connection with the element 24, the thickness of said shank 38 gradually lessens towards the top end starting from a well-defined portion 39. Said portion 39 performs a function similar to the portion 29 of the element 24, forming in fact a kind of end-of-travel stop.

The element 34 may slide inside the pocket 35 until the portion 39 comes into contact with the opening 36.

The shank 38 of the element 34, in fact, in the zone between the portion 39 and head-piece 37 of the element 34 has a thickness which is greater than the thickness of the pocket 35. As a result, sliding of the element 34 inside the pocket 35 beyond a well-defined point is prevented.

In the preferred embodiment, the width of the shank 38 is slightly smaller than the width of the pocket 35.

In this way the shank 38 is able to perform a slight rotation inside the pocket 35.

Operation of the protection means 20 and 30 will be described below with reference to FIGS. 6-10 and to three different configurations of the leg-piece 16 of the boot, i.e.:

rest configuration;

flexed configuration;

extended configuration.

In detail, the rest configuration occurs when the user's leg does not exert any pressure, either forwards or backwards, on the leg-piece of the boot. In said configuration, it may be considered, with a more or less acceptable degree of accuracy, that the axis of the leg-piece is perpendicular to the resting plane of the ground 40.

The flexed configuration occurs when the user's leg exerts a pressure on the front portion of the boot leg-piece which, as a result of this pressure, flexes forwards.

The extended configuration occurs, instead, when the user's leg exerts a pressure on the rear portion of the boot leg-piece. In this case the leg-piece flexes backwards.

FIGS. 6 and 7 show, respectively, the second protection means 30 and the first protection means 20 in the rest configuration. In this configuration there is no relative movement of the rear plate 32 and element 34 nor of the front plate 22 and element 24.

As soon as the user exerts a pressure on the front portion of the boot leg-piece, the leg-piece passes from the rest configuration into the flexed configuration.

In this configuration the front portion of the leg-piece 16 not only flexes forwards, but is also subject to a compression from the top downwards.

As shown in FIG. 7*b*, following said compression, the element 24 of the first protection means 20 slides upwards, remaining inside the pocket 25 and reducing the distance between its head-piece 27 and the top end of the first protection means 20.

In said flexed configuration, the rear portion of the leg-piece 16 also flexes forwards, but differently from that which occurs for the front portion of the leg-piece, is subject to a tensile force.

As shown in FIG. 6*b*, as a result of this tensile force, the element 34 of the second protection means 30 slides downwards, remaining inside the pocket 35 and increasing the distance between its head-piece 37 and the top end of the second protection means 30.

The width and the thickness of the pockets 25 and 35 allow the elements 24 and 34 to be guided during their movements and prevent the possibility of any misalignment between the various components which form the first protection means 20 and the second protection means 30.

It should be noted, also, that the element 24 may slide inside the pocket 25 until the portion 29 comes into contact with the opening of the protection means. It is clear, therefore, that the introduction of said protection means, on the one hand, increases the flexibility and the comfort of the boot, but, on the other hand, does not affect the required rigidity. In the case where the front portion of the leg-piece is subject to high compressive forces, the protection means are configured to ensure optimum protection of the leg.

It should be noted, moreover, that, when the element 24 reaches the end of its travel movement inside the first protection means 20, the movement of the element 34 inside the second protection means 30 also stops.

As mentioned above, the extended configuration of the leg-piece occurs when the user exerts a pressure on the rear portion of the leg-piece.

In this configuration the rear portion of the leg-piece not only flexes backwards, but is also subject to a compression from the top downwards.

As shown in FIG. 6*a*, following said compression, the element 34 of the second protection means 30 slides upwards, remaining inside the pocket 35 and reducing the distance between its head-piece 37 and the top end of the second protection means 30.

In said extended configuration, the front portion of the leg-piece 16 also flexes backwards, but differently from that which occurs for the rear portion of the leg-piece, is subject to a tensile force.

As shown in FIG. 7*a*, as a result of this tensile force, the element 24 of the first protection means 20 slides downwards, remaining inside the pocket 25 and increasing the distance between its head-piece 27 and the top end of the first protection means 20.

In a manner similar to that described in connection with the first protection means 20, the element 34 may also slide inside the pocket 35 until the portion 39 comes into contact with the opening of the pocket.

FIGS. 6 and 7 show the macroscopic movements which may be performed by the protection means 20 and 30.

In reality, as shown in detail in FIGS. 8, 9, 10 and 11, in the different configurations of the leg-piece, the particular form of the protection means allows both the element 24 and the element 34 not only to be displaced inside the respective guiding means 25, 35, but also to accompany the forwards or backwards flexing movement of the portion of the upper on which they are mounted.

In this way it is evident how both the front portion and the rear portion of the leg-piece 16, in the different configurations, always remain in close contact with the user's leg ensuring a high degree of comfort for the latter, while maintaining the same degree of safety offered by the boot 10.

Owing to the possibility of the relative movements of the components of the protection means 20 and 30, the boot 10 is able to fit also to different calf types.

In the case of large-size calf, the possibility of the rear plate 32 to flex with respect to the element 34 ensures an improved wearability.

Figure 1:
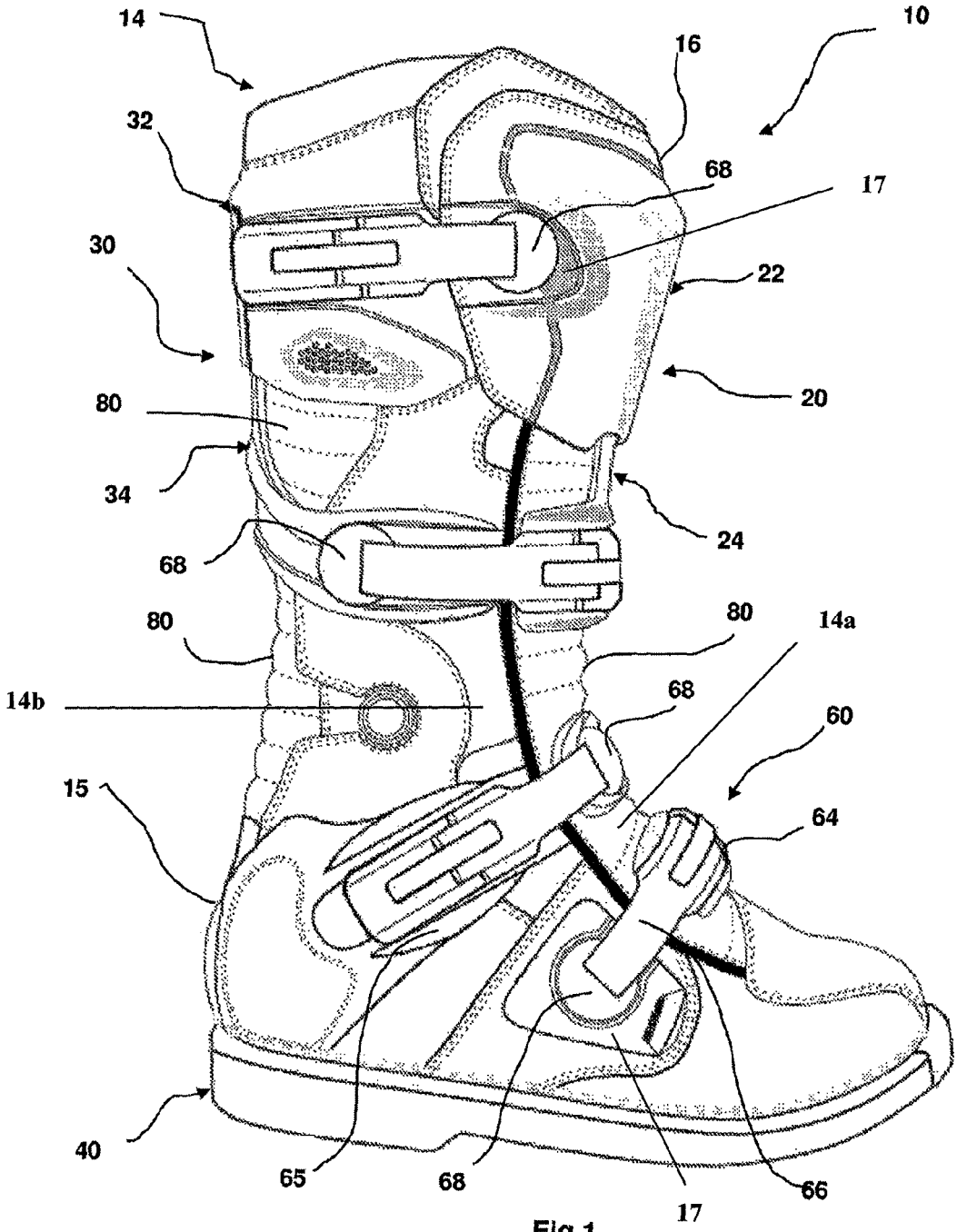
FIG. 1 shows a first side view of the boot according to the invention.
Figure 2:
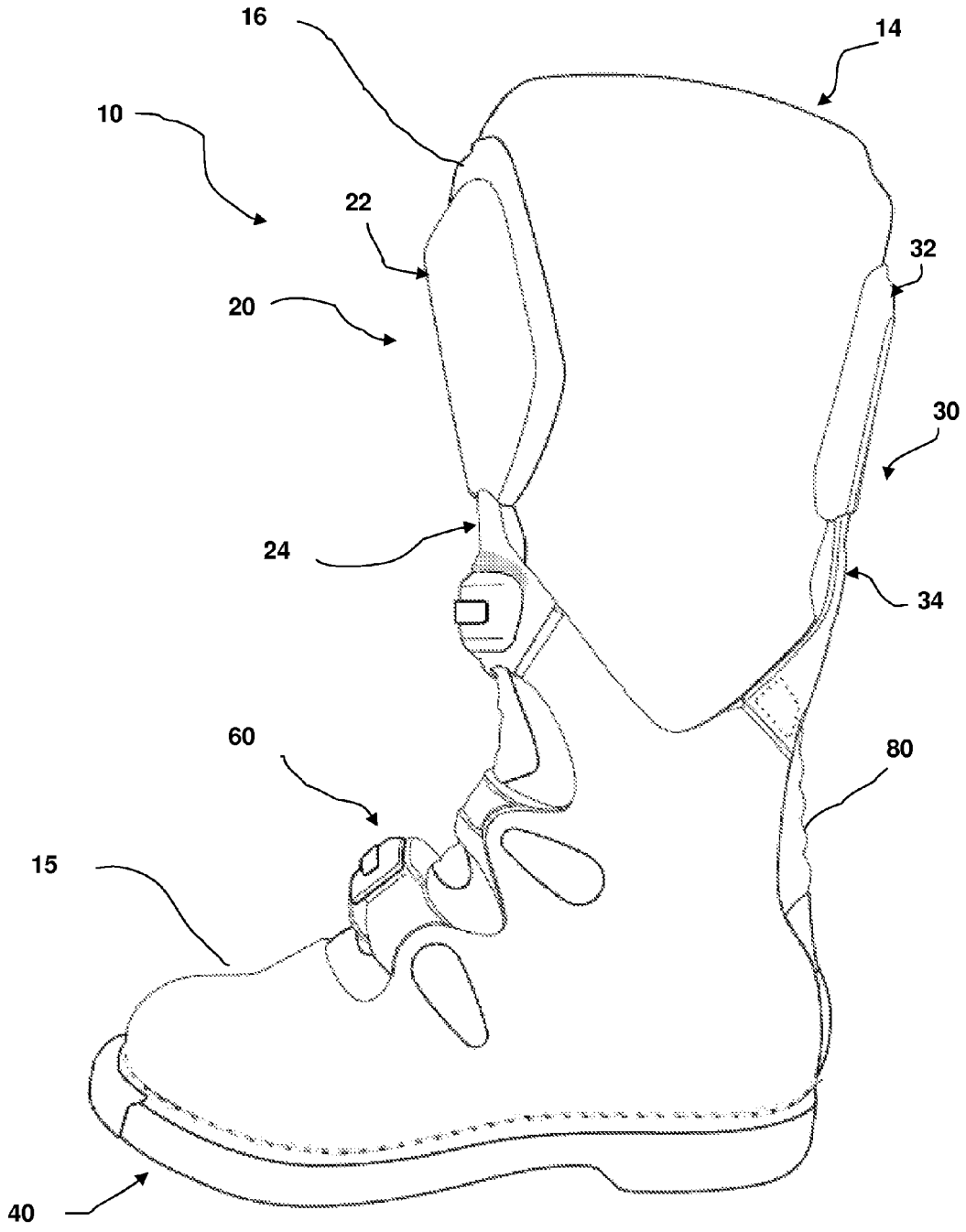
FIG. 2 shows a second side view of the boot according to the invention.

With reference to FIGS. 1, 4 and 7*a*, the boot 10 also comprises a plurality of closing fasteners which are denoted overall by the reference number 60.

Said fasteners 60 have the function of tightening, relative to each other, the opposite flaps 14*a* and 14*b* of the upper 14 so as to allow the boot 10 to adhere to the user's leg during use.

Each of said fasteners comprises: a toothed bar 62 and a lever 64 suitable for engaging with the toothed bar 62 in at least one position.

As shown in FIG. 1, and with reference to the lowermost fastener 60 of the boot 10, the lever 64, by means of the strap 66, is permanently connected to a first boot flap 14*a*.

The surface of the strap 66 facing the upper 14 of the boot 10 (not shown in the accompanying figures) has a toothed profile which may be engaged with the rack provided inside an eyelet 68 by means of which the strap 66 is fixed to the upper 14.

In this way, by pulling the strap outwards or causing it to slide inside the eyelet 68 it is possible for the user to adjust the length of the strap 66 as considered most appropriate.

The eyelets 68 are fixed to rigid or semi-rigid plastic inserts 17 suitably provided on the upper 14 of the boot 10. It is thus ensured that the eyelet 68, and consequently the base of the strap 66, does not become detached from the flap 14*a* or 14*b* of the upper 14 onto which it is fixed.

Each toothed bar 62 also has lateral projections 65 which have the function of covering the side edges of the lever 64, once the latter has engaged with the toothed bar 62. In this way suitable protection is provided against accidental opening of the lever 64 following impacts with foreign bodies.

An important technical feature of the boot 10 according to the present invention consists in the particular arrangement of the closing fasteners 60.

If the upper is defined as having a first flap 14*a* and a second flap 14*b*, the fixing eyelets 68 of the fasteners 60 are positioned alternately on the first and second flaps 14*a*, 14*b*.

As can be directly understood from FIGS. 1 and 4, considering firstly the bottom portion 15 of the upper 14, it can be noted that the eyelet 68 on the outside of the foot sole is positioned on the flap 14*b* of the upper 14 situated opposite to the flap 14*a* of the upper 14 on which the eyelet 68 of the instep is positioned.

Examining also the top portion 16 of the upper 15 it can be noted that the eyelet 68 on the side end of the element 34 is provided on the flap 14*b* of the upper situated opposite to the flap 14*a* of the upper 14 on which the eyelet 68 of the front plate 22 is positioned.

Said arrangement of closing fasteners 60 does not affect the wearability of the boot 10; in fact it does not prevent the user from widening as far as possible the opposite flaps 14*a*, 14*b* of the upper before putting on the boot 10 and thereby increases the wearability of the boot 10 as well as its comfort.

Advantageously the abovementioned arrangement of the closing fasteners 60 also allows suitable tension to be exerted on the bottom flap 14*b* of the upper 14 so that it adheres better to the user's foot and calf.

Both the top flap 14*a* and the bottom flap 14*b* of the upper co-operate actively to close the boot 10 and this means that there are not points where the closure is too tight or, on the other hand, points where the closure is too loose.

Moreover, the particular arrangement of the closing fasteners 60 reduces and practically eliminates the risk that the boot may open following an impact against solid bodies.

Finally, said closing fasteners may co-operate advantageously with the protection means 20 and 30 arranged in the vicinity of the leg-piece 16 of the boot 10.

In fact, they do not prevent sliding of the elements 24 and 34 inside the respective pockets and at the same time help ensure better adhesion of said protection means 20 and 30 to the top portion of the leg.

With regard to the embodiments of the boot 10 described above, the person skilled in the art may, in order to satisfy specific requirements, make modifications to and/or replace elements described with equivalent elements, without thereby departing from the scope of the accompanying claims.

The invention claimed is:

1. A motorcycling boot comprising:

a sole;

an upper comprising a bottom portion configured to surround a user's foot, and a leg-piece configured to surround a user's leg and extending from the bottom portion a distance to a top end, the top end having an opening for receiving the user's foot;

a first protection means positioned at a front, forward-oriented portion of said leg-piece;

a second protection means positioned at a rear, rearward-oriented portion of said leg-piece, the front portion and the rear portion of the leg-piece being opposing surfaces of said leg-piece;

wherein said first protection means comprises a front plate and an element that slides variably in said front plate during forward and rearward flexures of the leg-piece, the front plate located adjacent to the opening and affixed at a higher position on the leg-piece than the element, and the front plate comprising a bottom side within which the element slides, whereby a greater portion of the element is accommodated in the front plate during the forward flexures of the leg-piece than during the rearward flexures of the leg piece; and wherein said second protection means comprises a rear plate and an element that slides variably in said rear plate during the forward and rearward-flexures of the leg-piece, the rear plate located adjacent to the opening and affixed at a higher position on the leg-piece than the element.

2. The motorcycling boot of claim 1, wherein the element of said first protection means has a substantially same shape as an overturned T and is configured to correspond with a central portion of a user's shin-bone.

3. The motorcycling boot of claim 1, wherein the element of said second protection means has a substantially same shape as an overturned Y and is configured to correspond with a central, bottom portion of a user's calf muscle.

4. The motorcycling boot of claim 1, wherein a first guiding means is arranged in a central portion of the front plate; said first guiding means consisting of a pocket with a substantially rectangular shape and in which the element of the first protection means variably slides.

5. The motorcycling boot of claim 1, wherein a second guiding means is arranged in a central portion of the rear plate; said second guiding means consisting of a pocket with a substantially rectangular shape and in which the element of the second protection means variably slides.

6. The motorcycling boot of claim 1, wherein the element of the first protection means includes a shank, wherein a thickness of a portion of the shank gradually lessens as the shank portion extends from a well-defined portion of the first protection means element toward a top end of the first protection means element.

7. The motorcycling boot of claim 1, wherein the element of the second protection means includes a shank, wherein a thickness of a portion of the shank gradually lessens as the shank portion extends from a well-defined portion of the second protection means element toward a top end of the second protection means element.

8. The motorcycling boot of claim 1, further comprising a plurality of closing fasteners, said closing fasteners being fixed to the upper by means of fixing eyelets arranged alternately on first and second flaps of the upper.

9. The motorcycling boot of claim 8, wherein said fixing eyelets are fixed to one of rigid or semi-rigid plastic inserts suitably provided on the upper.

10. The motorcycling boot of claim 1, wherein sliding direction of said element of the first protection means is generally opposite sliding direction of said element of the second protection means during the forward and rearward flexures of the leg-piece.

11. The motorcycling boot of claim 1, wherein the rear plate comprises a bottom side within which the element of the second protection means slides, whereby a greater portion of the element is accommodated in the rear plate during the rearward flexures of the leg-piece than during the forward flexures of the leg-piece.

12. The motorcycling boot of claim 1, wherein the forward and rearward flexures of the leg-piece result in respective compression and tension of the forward-oriented portion of said leg-piece, wherein the sliding of the element of the first protection means in the front plate prevents misalignment of the front plate with corresponding portion of the user's leg.

13. The motorcycling boot of claim 12, wherein said front plate is configured to correspond with a top and corresponding outer side portion of a user's shin.

14. The motorcycling boot of claim 2, wherein said rear plate is configured to correspond with a top and corresponding outer side portion of a user's calf.

15. The motorcycling boot of claim 14, wherein the element of said second protection means has a substantially same shape as an overturned Y and is configured to correspond with a central, bottom portion of a user's calf muscle.

16. The motorcycling boot of claim 14, wherein a second guiding means is arranged in a central portion of the rear plate, said second guiding means consisting of a pocket with a substantially rectangular shape and in which the element of the second protection means variably slides.

17. The motorcycling boot of claim 14, wherein the element of the second protection means includes a shank, wherein a thickness of a portion of the shank gradually lessens as the shank portion extends from a well-defined portion of the second protection means element toward a top end of the second protection means element.

18. The motorcycling boot of claim 14, further comprising a plurality of closing fasteners, said closing fasteners being fixed to the upper by means of fixing eyelets arranged alternately on first and second flaps of the upper.

19. The motorcycling boot of claim 2, wherein the element of said first protection means has a substantially same shape as an overturned T and is configured to correspond with a central portion of a user's shin bone.

20. The motorcycling boot of claim 19, wherein a first guiding means is arranged in a central portion of the front plate, said first guiding means consisting of a pocket with a substantially rectangular shape and in which the element of the first protection means variably slides.

21. The motorcycling boot of claim 19, wherein the element of the first protection means includes a shank, wherein a thickness of a portion of the shank gradually lessens as the shank portion extends from a well-defined portion of the first protection means element toward a top end of the first protection means element.

22. The motorcycling boot of claim 1, wherein the forward and rearward flexures of the leg-piece result in respective tension and compression of the rearward-oriented portion of said leg-piece, wherein the sliding of the element of the second protection means in the rear plate prevents misalignment of the rear plate with corresponding portion of the user's leg.

23. The motorcycling boot of claim 22, wherein said rear plate is configured to correspond with a top and corresponding outer side portion of a user's calf.

24. The motorcycling boot of claim 1, wherein the front plate and the element of the first protection means and the rear plate and the element of the second protection means are fixed in non-removable manner to the respective front and rear portions of the leg-piece.

25. The motorcycling boot of claim 10, wherein the element of the first protection means slides upward while the element of the second protection means slides downward during the forward flexure of the leg-piece.

26. The motorcycling boot of claim 21, wherein the element of the first protection means slides downward while the element of the second protection means slides upward during the rearward flexure of the leg-piece.

27. The motorcycling boot of claim 1, wherein the element of the first protection means comprises a shank, a majority of the shank being accommodated in the front plate following the forward flexures of the leg-piece.

28. A motorcycling boot comprising:

a sole;

an upper comprising a bottom portion configured to surround a user's foot, and a leg-piece configured to surround a user's leg and extending from the bottom portion a distance to a top end, the top end having an opening for receiving the user's foot;

a first protection means positioned at a front, forward-oriented portion of said leg-piece;

a second protection means positioned at a rear, rearward-oriented portion of said leg-piece, the front portion and the rear portion of the leg-piece being opposing surfaces of said leg-piece;

wherein said first protection means comprises a front plate and an element that slides variably in said front plate during forward and rearward flexures of the leg-piece, the front plate located adjacent to the opening and affixed at a higher position on the leg-piece than the element; and wherein said second protection means comprises a rear plate and an element that slides variably in said rear plate during the forward and rearward flexures of the leg-piece, the rear plate located adjacent to the opening and affixed at a higher position on the leg-piece than the element, and the rear plate comprising a bottom side within which the element slides, whereby a greater portion of the element is accommodated in the rear plate during the rearward flexures of the leg-piece than during the forward flexures of the leg piece.

* * * * *